US007311135B1

(12) United States Patent
Suganuma et al.

(10) Patent No.: US 7,311,135 B1
(45) Date of Patent: Dec. 25, 2007

(54) PROCESS FOR MANUFACTURING A NANOCARBON-METAL COMPOSITE MATERIAL

(75) Inventors: Masashi Suganuma, Nagano (JP); Atsushi Kato, Nagano (JP); Shigeharu Kamado, Nagaoka (JP); Daisuke Tsushima, Matsumoto (JP)

(73) Assignees: Nissei Plastic Industrial Co., Ltd., Nagano (JP); Nagaoka University of Technology, Niigata (JP)

( * ) Notice: Subject to any disclaimer, the term of this patent is extended or adjusted under 35 U.S.C. 154(b) by 84 days.

(21) Appl. No.: 11/440,240

(22) Filed: May 24, 2006

(30) Foreign Application Priority Data

May 27, 2005 (JP) ..... P2005-155652

(51) Int. Cl.
*B22D 19/14* (2006.01)
*B21C 25/02* (2006.01)

(52) U.S. Cl. ..... 164/97; 164/76.1; 72/273

(58) Field of Classification Search ..... 164/76.1, 164/97; 72/273
See application file for complete search history.

(56) References Cited

U.S. PATENT DOCUMENTS 6,874,563 B2 * 4/2005 Koide et al. ..... 164/97

FOREIGN PATENT DOCUMENTS

| | | | |
|---|---|---|---|
| JP | 10-168502 | * | 8/1998 |
| JP | 2004-131758 | | 4/2004 |
| JP | 2007-154246 | * | 6/2007 |

* cited by examiner

*Primary Examiner*—Kuang Lin
(74) *Attorney, Agent, or Firm*—Hamre, Schumann, Mueller & Larson, P.C.

(57) ABSTRACT

A composite material composed of nanocarbon materials and metallic materials for a matrix is extrusion molded to have the nanocarbon materials oriented in one direction.

5 Claims, 5 Drawing Sheets

PROCESS FOR MANUFACTURING A NANOCARBON-METAL COMPOSITE MATERIAL

FIELD OF THE INVENTION

The present invention relates to a process for manufacturing a nanocarbon-metal composite material composed of nanocarbon materials and matrix metal materials.

BACKGROUND OF THE INVENTION

Attention has recently come to be attracted to special carbon fibers called nanocarbon fibers. Nanocarbon fibers are substances shaped like cylindrically wound sheets of carbon atoms arranged in a hexagonal mesh and having a diameter of 1.0 to 150 nm (nanometers) and a length of several to 100 μm. These substances are called, e.g., nanocarbon fibers or nanocarbon tubes (hereinafter referred to as nanocarbon materials), since they have a nano-sized diameter.

The nanocarbon materials comprise a material of high thermal conductivity, as well as a reinforcing material, and can improve the thermal conductivity of a metallic material in which it is mixed.

The nanocarbon materials provide an improved thermal conductivity when they extend in the direction in which heat is conducted. Thus, a method in which nanocarbon materials are arranged in a certain direction has been proposed by JP-A-2004-131758.

The proposed method will now be described with reference to FIG. 5. FIG. 5 shows a cooling drum 101, a groove 102 formed around the cooling drum 101, a container 103, a molten material 104, a solidified material 105, a rolling mill 106 and a cutter 107.

The molten material 104 prepared by mixing nanocarbon materials in molten aluminum is fed from its container 103 to the groove 102 on the cooling drum 101 at a constant flow rate. The cooling drum 101 is rotated at a high speed giving it an outer peripheral velocity which is higher than the flow rate of the molten material 104.

The molten material 104 is, therefore, drawn along the groove 102 and the nanocarbon materials are oriented in the direction in which the molten material is drawn. At the same time, it is cooled and solidified into the solidified material 105.

The solidified material 105 is rolled by the rolling mill 106 and cut by the cutter 107 to give rod-shaped materials 108. The rod-shaped materials 108 have a thickness of 0.1 to 2.0 mm. The rod-shaped materials 108 have their thermal conductivity elevated drastically along their length by the nanocarbon materials oriented along their length.

However, a large amount of heat energy is consumed to heat aluminum to its melting point to prepare the molten material 104.

If the cooling drum 101 is rotated too fast, the molten material 104 is torn and if it is rotated too slowly, the nanocarbon materials fail to be oriented uniformly. Thus, the rotating speed of the cooling drum 101 requires difficult control. The solidification of the molten material 104 cooled on the cooling drum 101 proceeds from its surface to its center. When a material containing a foreign substance solidifies from its surface to its center, the foreign substance (nanocarbon materials in the context of the present invention) tends to gather in the center. Thus, the nanocarbon materials lack uniformity in distribution and give a composite product of lower strength. The deficiency of nanocarbon materials in the skin of the product lowers its surface hardness and wear resistance.

Accordingly, the known method in which the molten material 104 is drawn by the cooling drum 101 needs to be improved in the control of the rotating speed of the cooling drum and the surface hardness of the product.

SUMMARY OF THE INVENTION

According to the present invention, therefore, there is provided a process for manufacturing a nanocarbon-metal composite material which comprises the steps of mixing nanocarbon materials and metallic materials for a matrix, compressing their mixture to form a compact, covering the compact by a material having a melting point higher than that of the metallic materials, heating the covered compact in an inert or non-oxidizing gas atmosphere to a temperature in the temperature range in which the solid and liquid phases of the metallic materials can coexist, applying pressure to the heated compact to form a primary molded product by plastic deformation and extrusion molding the primary molded product to produce a nanocarbon-metal composite material.

In the inventive process, the nanocarbon materials are oriented in one direction by extrusion molding. The covered compact is heated to a temperature in the temperature range in which the solid and liquid phases can coexist. The process does not include any step of melting the metallic materials, but realizes the corresponding saving of energy.

No sophisticated operating skill, such as rotating speed control, is required in any of the mixing, compact forming, covering, heating, plastic deformation and extrusion steps. In the step of forming a primary molded product, the plastic deformation of the covered compact heated to a temperature in the temperature range in which the solid and liquid phases can coexist, causes the metallic matrix materials to produce a metal-rich liquid phase, in which the nanocarbon materials are dispersed. This makes it possible to disperse the nanocarbon materials uniformly in the metallic materials and thereby produce a nanocarbon-metal composite material of high mechanical strength.

The metallic materials solidify before extrusion molding and restrict the movement of the nanocarbon materials. There is no movement of nanocarbon materials from the skin of the molded product to its center. Accordingly, it is possible to manufacture a nanocarbon-metal composite material containing a sufficiently large amount of nanocarbon materials in its skin and therefore having a surface of improved wear resistance.

Thus, the present invention makes it possible to realize an elevated surface hardness, as well as energy saving, in a process for manufacturing nanocarbon materials oriented in one direction.

The metallic materials for the matrix are preferably in the form of chips. As chips are solid pieces, they have a relatively small surface area relative to their mass. A small surface area means a small scale of surface oxidation forming a small amount of oxide sludge. The formation of only a small amount of oxide sludge ensures the manufacture of a nanocarbon-metal composite material of high purity.

The metallic materials for the matrix are preferably of a low-melting metal or alloy having a melting point not exceeding 660° C. The low-melting metal or alloy is easy to feed to a die casting machine. Thus, the present invention makes it possible to manufacture a nanocarbon-metal composite material permitting a broad scope of application.

The low-melting metal or alloy is preferably magnesium or a magnesium alloy. As magnesium or a magnesium alloy is a light metal or alloy, its combination with nanocarbon materials provides a structural material which is light in weight and outstanding in strength, thermal conductivity and wear resistance.

The covering material is preferably aluminum or an aluminum alloy. The covering of the compact by aluminum or an aluminum alloy having a melting point higher than that of magnesium or a magnesium alloy forming the matrix protects the latter against oxidation. Moreover, the use of aluminum or an aluminum alloy, which is a common and easily available material, realizes a reduction in the cost of manufacture.

BRIEF DESCRIPTION OF THE DRAWINGS

Several preferred embodiments of the present invention will now be described with reference to the accompanying drawings, in which.

DETAILED DESCRIPTION OF THE PREFERRED EMBODIMENTS

Figure 1A:
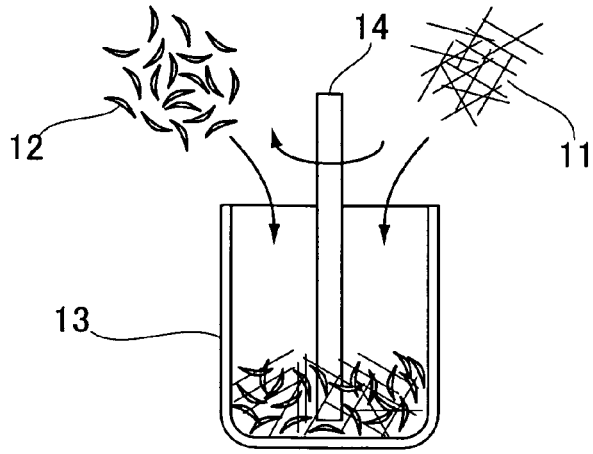
FIGS. 1A to 1C show the mixing and compact forming steps in the process of the present invention.
Figure 1B:
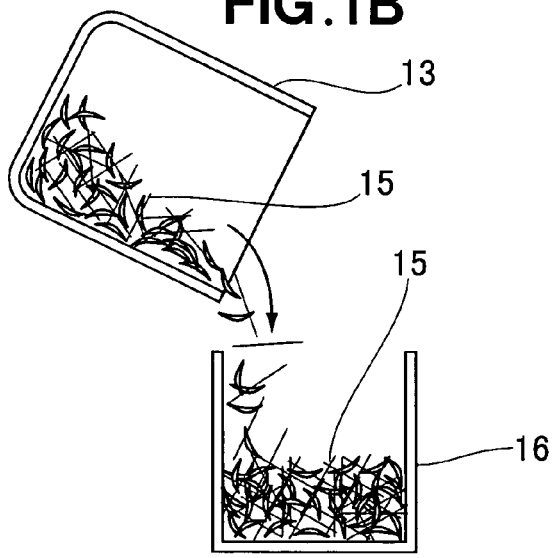
Figure 1C:
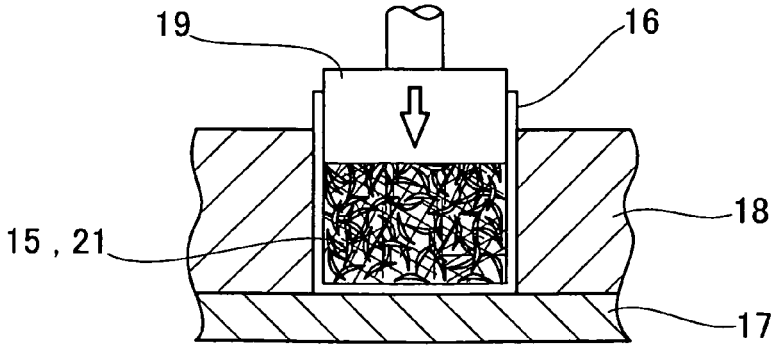

Description will first be made of the mixing and compact forming steps in the process of the present invention with reference to FIGS. 1A to 1C. Nanocarbon materials 11 and metallic matrix materials 12 prepared by cutting from a metal block are placed in a container 13 and mixed thoroughly by a rod 14, as shown in FIG. 1A. The metallic matrix materials 12 are, for example, of a magnesium alloy. A mixture 15 obtained by thorough mixing is transferred into an aluminum can 16, as shown in FIG. 1B. The aluminum can 16 is placed on a base 17 and surrounded by a die 18, as shown in FIG. 1C. Then, a punch 19 is moved into the aluminum can 16 to compress the mixture 15. The compressed mixture is called a compact 21.

Figure 2A:
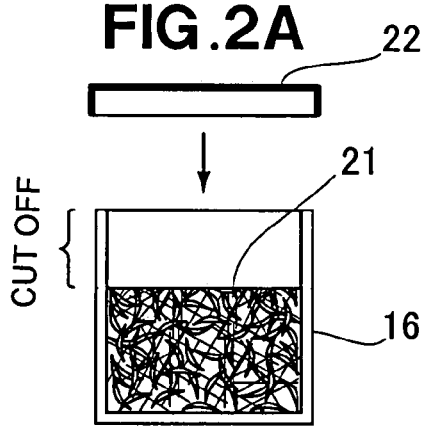
FIGS. 2A to 2C show the heating step in the process of the present invention.

Description will now be made of the heating step in the process of the present invention with reference to FIGS. 2A to 2C. The compact 21 is covered with a metallic material having a melting point higher than that of the metallic matrix materials 12 (FIG. 1A), as shown in FIG. 2A, and is thereby protected against oxidation. Specifically, when the metallic matrix materials are of a magnesium alloy, an aluminum material having a higher melting point is used as a covering material. More specifically, that portion of the aluminum can 16 which protrudes from the compact 21 is cut off. Then, an aluminum sheet 22 is placed on the top of the compact 21. There is obtained a covered compact having the compact 21 covered by the metallic material (aluminum can 16 and aluminum sheet 22) having a melting point higher than that of the metallic matrix materials 12.

Figure 2B:
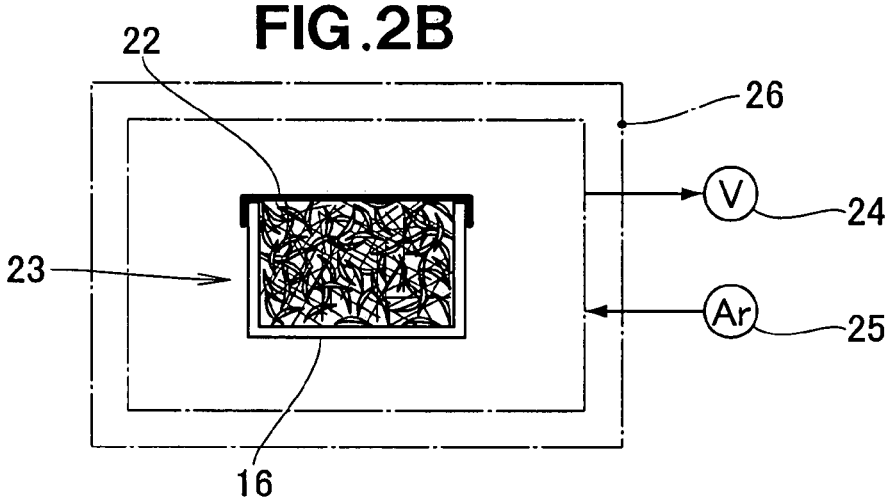

In the event that the oxidation of the covered compact 23 is feared during some time before the next treatment, the covered compact 23 is stored in a non-oxidizing tank 26 evacuated through an evacuating device 24 and filled with argon gas from an argon container 25, as shown in FIG. 2B. Argon gas is an inert gas and is effective for preventing oxidation.

Figure 2C:
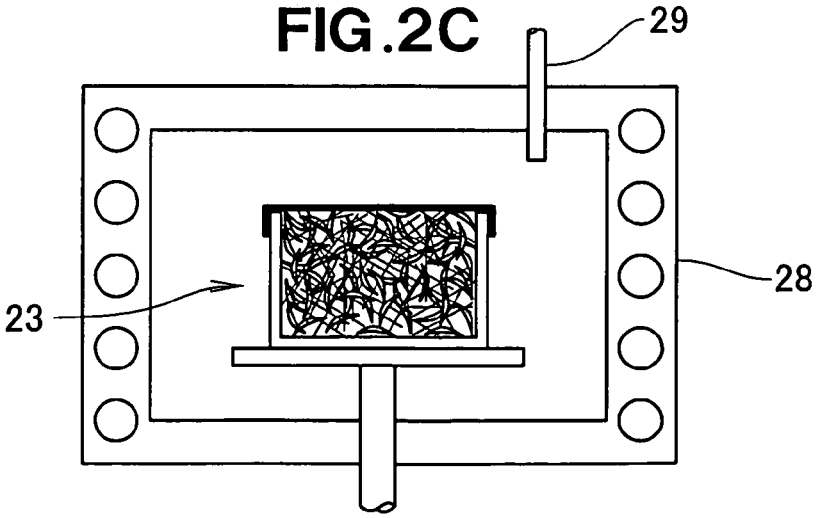

Then, the covered compact 23 is placed in a heating furnace 28 and a non-oxidizing gas, such as a mixture of carbon dioxide and sulfur hexafluoride ($SF_6$), is blown into the furnace 28 through a gas tube 29, as shown in FIG. 2C. The compact 23 is heated to a temperature in the temperature range in which the solid and liquid phases of the metallic matrix materials 12 (FIG. 1A) can coexist.

Description will now be made of the plastic deformation step in the process of the present invention with reference to FIGS. 3A to 3C. The following is a description of the case in which a pressing machine 30 is employed for plastic deformation, though a rolling mill or a forging machine may alternatively be employed.

Figure 3A:
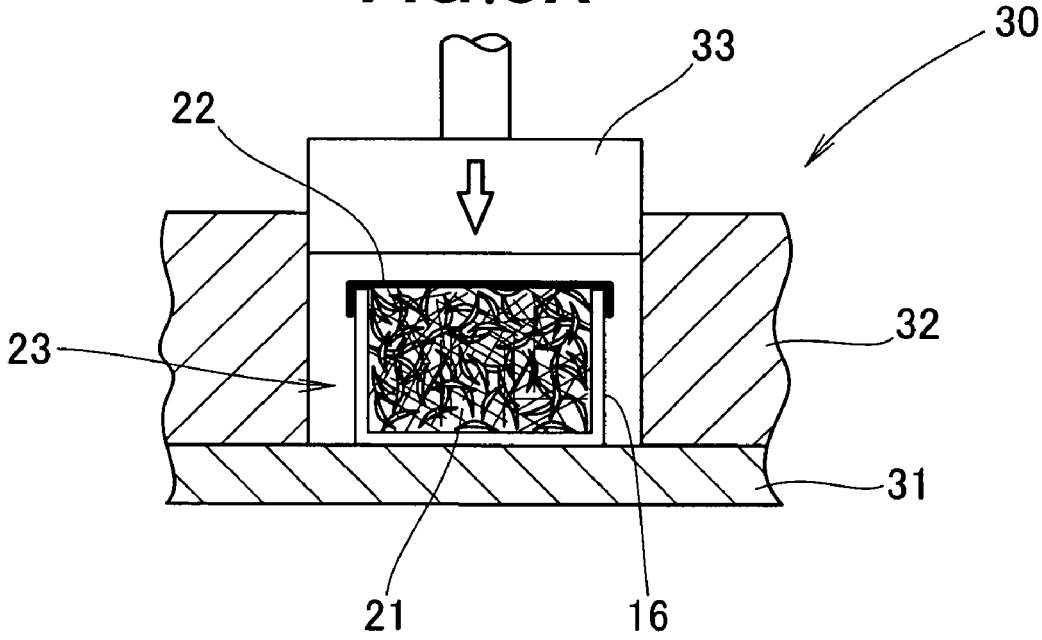
FIGS. 3A to 3C show the plastic deformation step in the process of the present invention.
Figure 3B:
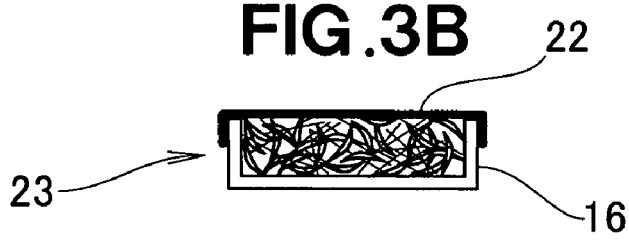
Figure 3C:
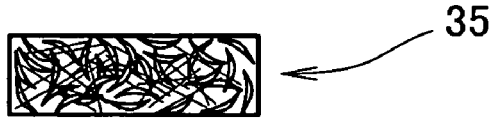

The pressing machine 30 has a base 31, a die 32 and a punch 33 and is used to compress the covered compact 23, as shown in FIG. 3A. The covered compact 23 is decreased in height and increased in diameter, as shown in FIG. 3B. Then, the aluminum can 16 and aluminum sheet 22 are removed from the covered compact 23 to give a primary molded product 35, as shown in FIG. 3C. When the covered compact 23 heated to the temperature range in which the solid and liquid phases of the metallic matrix materials can coexist is plastically deformed to form the primary molded product 35, a metal-rich liquid phase oozes out of the metallic matrix materials and allows the nanocarbon materials to be dispersed therein.

Figure 4A:
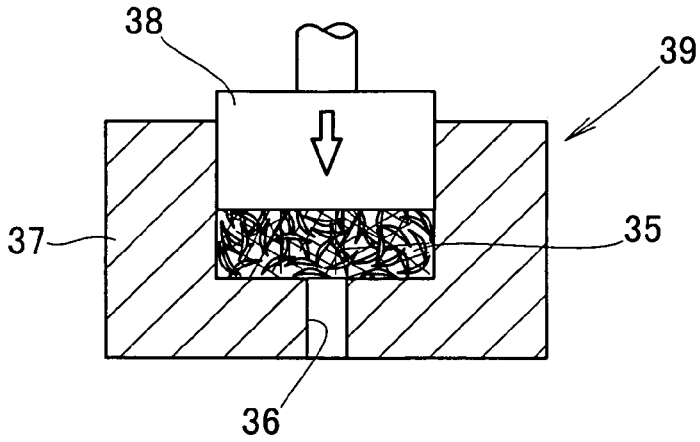
FIGS. 4A to 4C show the extrusion step in the process of the present invention.
Figure 4B:
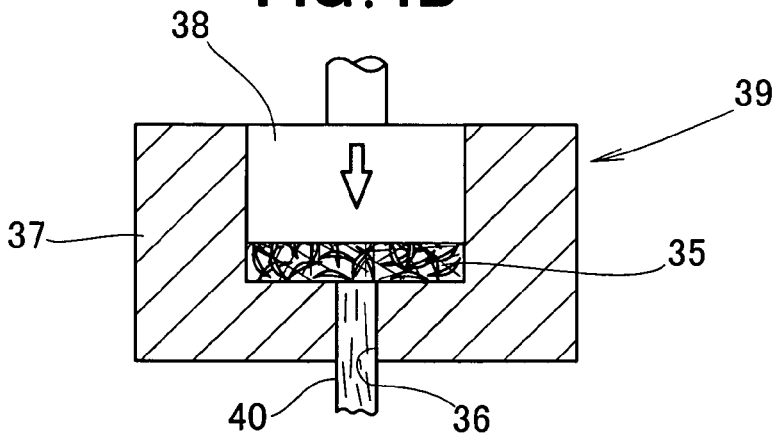
Figure 4C:
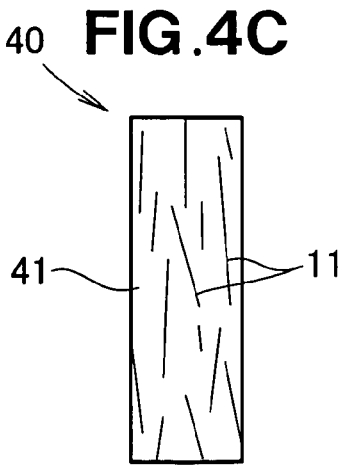
Figure 5:
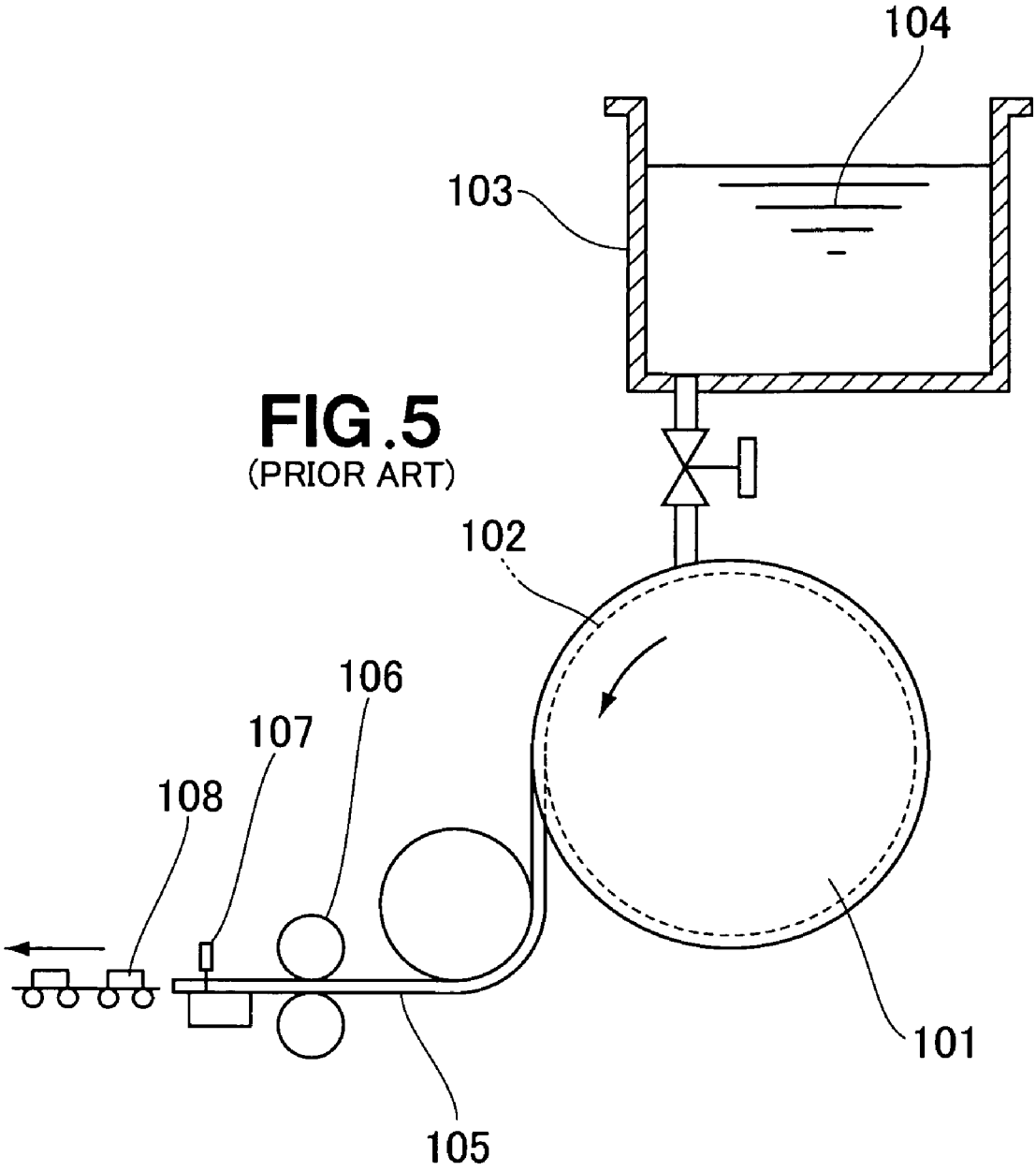
FIG.5 (PRIOR ART)
FIG. 5 shows a known apparatus for manufacturing a nanocarbon-metal composite material.

Description will now be made of the extrusion step in the process of the present invention with reference to FIGS. 4A to 4C. FIG. 4A shows an extruder 39 including a container 37 having an extruding passage 36 and a ram 38. The container 37 is heated to an appropriate temperature and the primary molded product 35 is placed in the container 37. Then, the ram 38 is moved down as shown by an arrow to extrude the primary molded product 35 through the extruding passage 36 to form a nanocarbon-metal composite material 40. The nanocarbon-metal composite material 40 carries in its surface 41 the nanocarbon materials 11 oriented in the direction of extrusion, as shown in FIG. 4C. Its surface 41 containing a satisfactorily large amount of nanocarbon materials 11 presents an improved wear resistance.

EXPERIMENTAL EXAMPLES

The present invention will now be described by several experimental examples, though these examples are not intended for limiting the scope of the present invention.

1. Nanocarbon Materials Used in the Experiments

Nanocarbon fibers (hereinafter CNF) having a diameter of 1.0 to 150 nm (nanometers) and a length of several to 100 μm.

2. Metallic Matrix Materials Used in the Experiments

Magnesium alloy die casting (JIS H 5303 MDC1D) chips (hereinafter MD1D).

3. Mixing Step 3.1. Mixing Ratio:

Sample No. 01: 5 vol % CNF/95 vol % MD1D

Sample No. 02: 5 vol % CNF/95 vol % MD1D

Sample No. 03: 10 vol % CNF/90 vol % MD1D

Sample No. 04: 10 vol % CNF/90 vol % MD1D

Sample No. 05: 15 vol % CNF/85 vol % MD1D

Sample No. 06: 15 vol % CNF/85 vol % MD1D

4. Covering Step (for Samples Nos. 01 to 06)

An aluminum can and an aluminum foil were used for covering.

5. Heating Step (for Samples Nos. 01 to 06)

Heating temperature: 585° C.
Heating time: 30 minutes
Intended solid phase ratio: About 40%

6. Plastic Deformation Step (for Samples Nos. 01 to 06)

Pressure: 100 MPa

7. Extrusion Step (for Samples Nos. 02, 04 and 06)

Container temperature: 300° C.
Extrusion ratio (inner sectional area of container/area of hole)=256/16
Ram speed: 8 or 16 mm/s 8. Results Samples Nos. 01 to 06 were each examined for thermal conductivity and compressive strength. The results are shown in the following table:

TABLE 1

| Sample No. | CNF | MD1D | Elastic deformation step | Extrusion step | Thermal conductivity (W/m · K) | Compressive strength (MPa) |
|---|---|---|---|---|---|---|
| 01 | 5 vol % | 95 vol % | ○ | x | 42.2 | 369 |
| 02 | 5 vol % | 95 vol % | ○ | ○ | 47.0 | 378 |
| 03 | 10 vol % | 90 vol % | ○ | x | 43.2 | 384 |
| 04 | 10 vol % | 90 vol % | ○ | ○ | 50.7 | 393 |
| 05 | 15 vol % | 85 vol % | ○ | x | 46.0 | 356 |
| 06 | 15 vol % | 85 vol % | ○ | ○ | 52.8 | 361 |

○: Employed
x: Not employed

Samples Nos. 01 and 02 were both a combination of 5 vol % CNF and 95 vol % MD1D. While Sample No. 01 for which the extrusion step had not been employed showed a thermal conductivity of only 42.2 W/m·K, Sample No. 02 for which the extrusion step had been employed had a thermal conductivity raised to 47.0 W/m·K. A similar tendency was found when they were compared in compressive strength. While Sample No. 01 for which the extrusion step had not been employed showed a compressive strength of only 369 MPa, Sample No. 02 for which the extrusion step had been employed had a compressive strength raised to 378 MPa.

Samples Nos. 03 and 04 were both a combination of 10 vol % CNF and 90 vol % MD1D. While Sample No. 03 for which the extrusion step had not been employed showed a thermal conductivity of only 43.2 W/m·K, Sample No. 04 for which the extrusion step had been employed had a thermal conductivity raised to 50.7 W/m·K. A similar tendency was found when they were compared in compressive strength. While Sample No. 03 for which the extrusion step had not been employed showed a compressive strength of only 384 MPa, Sample No. 04 for which the extrusion step had been employed had a compressive strength raised to 393 MPa.

Samples Nos. 05 and 06 were both a combination of 15 vol % CNF and 85 vol % MD1D. While Sample No. 05 for which the extrusion step had not been employed showed a thermal conductivity of only 46.0 W/m·K, Sample No. 06 for which the extrusion step had been employed had a thermal conductivity raised to 52.8 W/m·K. A similar tendency was found when they were compared in compressive strength. While Sample No. 05 for which the extrusion step had not been employed showed a compressive strength of only 356 MPa, Sample No. 06 for which the extrusion step had been employed had a compressive strength raised to 361 MPa.

The results stated above teach that the extrusion step brings about an increase in both thermal conductivity and compressive strength. Their increase apparently owes itself to the orientation of nanocarbon materials by the extrusion step.

A wear test was conducted on some of Samples to estimate their wear resistance. A columnar test specimen, having a diameter of 8 mm and a spherical end of 70 mm in radius, was prepared from each of Samples Nos. 03 and 04. Then, the spherical end was held against a friction plate of S45C carbon steel with a pressure of 200 N and was reciprocated along a sliding distance of 10,000 m at a sliding speed of 1 m/s. The test specimen was partly worn and the amount of its wear was geographically calculated. The results are shown in the following table:

TABLE 2

| Sample No. | CNF | MD1D | Plastic deformation step | Extrusion step | Wear |
|---|---|---|---|---|---|
| 03 | 10 vol % | 90 vol % | ○ | x | 5 $mm^3$ |
| 04 | 10 vol % | 90 vol % | ○ | ○ | 4 $mm^3$ |

○: Employed
x: Not employed

Samples Nos. 03 and 04 were both a combination of 10 vol % CNF and 90 vol % MD1D. While Sample No. 03 for which the extrusion step had not been employed showed a wear of as large as 5 $mm^3$, Sample No. 04 for which the extrusion step had been employed showed a wear of as small as 4 $mm^3$. As a smaller amount of wear means a higher wear resistance, it follows that the extrusion step brings about an improved wear resistance.

In addition to magnesium or a magnesium alloy having a melting point of about 650° C., it is possible to use as the metallic matrix materials aluminum or an aluminum alloy having a melting point of about 660° C., tin or a tin alloy having a melting point of about 232° C., or lead or a lead alloy having a melting point of about 327° C. In other words, any low-melting metal or alloy can be employed if its melting point does not exceed 660° C.

What is claimed is:

1. A process for manufacturing a nanocarbon-metal composite material, comprising the steps of:

mixing nanocarbon materials and metallic materials for a matrix;

compressing their mixture to form a compact;

covering the compact by a material having a melting point higher than that of the metallic materials;

heating the covered compact in an inert or non-oxidizing gas atmosphere to a temperature in the temperature range in which the solid and liquid phases of the metallic materials can coexist;

applying pressure to the heated compact to form a primary molded product by plastic deformation; and extrusion molding the primary molded product to produce a nanocarbon-metal composite material.

2. A process as set forth in claim 1, wherein the metallic materials are in the form of chips.

3. A process as set forth in claim 1, wherein the metallic materials are of a low-melting metal or alloy having a melting point of 660° C. or lower.

4. A process as set forth in claim 3, wherein the low-melting metal or alloy is magnesium or a magnesium alloy.

5. A process as set forth in claim 1, wherein the covering material is aluminum or an aluminum alloy.

* * * * *